United States Patent [19]

Norman

[11] Patent Number: 4,892,246

[45] Date of Patent: Jan. 9, 1990

[54] POSTCARD WITH TEAR OUT RETURN POSTCARD

[75] Inventor: John A. Norman, Downers Grove, Ill.

[73] Assignee: Uarco Incorporated, Barrington, Ill.

[21] Appl. No.: 293,977

[22] Filed: Jan. 6, 1989

[51] Int. Cl.[4] ..... B42D 15/04

[52] U.S. Cl. ..... 229/92.8

[58] Field of Search ..... 229/92.8, 92.1, 73

[56] References Cited

U.S. PATENT DOCUMENTS

| | | | |
|---|---|---|---|
| 1,311,397 | 7/1919 | Herter | 229/92.8 |
| 1,944,853 | 1/1934 | Unger | 229/92.1 |
| 1,957,374 | 5/1934 | Unger | 229/92.8 |
| 2,153,504 | 4/1939 | Didier | 229/92.8 |
| 2,270,455 | 1/1942 | Lichter | 229/92.8 |
| 2,279,164 | 4/1942 | Gettleman | 229/92.8 |
| 2,328,380 | 8/1943 | Feder | 229/92.8 |

*Primary Examiner*—Stephen P. Garbe

*Attorney, Agent, or Firm*—Wood, Dalton, Phillips, Mason & Rowe

[57] ABSTRACT

A simplified business form including a return postcard overcomes the problems of ease of use by recipient in a construction including first and second superimposed plies 10, 12 of which at least one 10 is of card stock like that employed in postcards. Glue or folds 16, 18, 24, 26; 72 join the peripheries of the plies 10, 12 to hold the same in substantial abutment with each other and a closed line of weakening 42 is located in one ply 10 and defines the periphery of return postcard 52. A franking designation or stamp receiving area 68 is located on the one ply 10 on the side thereof facing the other ply 12 within the closed line of weakening 42.

10 Claims, 2 Drawing Sheets

POSTCARD WITH TEAR OUT RETURN POSTCARD

FIELD OF THE INVENTION

This invention relates to mailing pieces that include provision whereby the recipient of the mailing piece may return information to the original sender, and more particularly, to a post card provided with a return postcard.

BACKGROUND OF THE INVENTION

It has long been known that an increased rate of response to mail solicitation can be achieved if the original, soliciting mailing includes provision to simplify the actions required by the recipient in responding to the original mailing. Thus, such mailings conventionally employ return envelopes, return postcards, etc. which are most often franked or provided with a postage stamp so that the recipient need not even concern himself with the payment of postage.

Indeed, with the advent of mailers as proposed in, for example, U.S. Pat. No. 3,104,799, virtually an entire new industry was created.

While mailers of the type disclosed in U.S. Pat. No. 3,104,799 have been very successful for their intended purpose, they are basically envelope type mailers provided with return envelopes and thus may be more expensive to manufacture and more expensive to post than is necessary in those instances where postcard type assemblies could be used.

It is, of course, known to provide so-called "two-way" postcards. In a typical two-way postcard, a single piece of card stock of twice the size of an ordinary postcard is folded in half upon itself and the edges remote from the fold of the two resulting leaves stapled together. On one of the facing interior surfaces, a return mailing address together with franking is provided. On one of the exterior surfaces of the construction, and generally that which is on the leaf other than that containing the interior return address, there will be provided a franking area as well as a mailing address receiving area. The other exterior surface may be provided with indicia requesting data, etc.

The postcard is mailed to a recipient who hopefully will respond to the data requesting indicia, break the stapled connection between the leaves and either reverse fold the card and restaple the same to expose the return address while hiding the original address or simply remove and discard the leaf bearing the original address to result in a return postcard bearing only the return address and the #data.

Where the card is reverse folded and reassembled, the recipient must perform a positive act, usually stapling, which may retard the rate of the response. Where the leaf of the card bearing the original address is removed and discarded, the identity of the original recipient must be inscribed on the data bearing portion of the return card which requires an additional operation either by the mailing organization or by the recipient since such address must also appear on the exterior surface of the original assemblage bearing the franking designation.

The present invention is directed to overcoming one or more of the above problems.

SUMMARY OF THE INVENTION

It is the principal object of the invention to provide a new and improved business form which preferably, though not necessarily, is utilized as a simplified two-way mailer including a return postcard.

An exemplary embodiment of a business form made according to the invention includes first and second superimposed plies. At least one of the plies is of card stock like that employed in postcards and the two plies have generally identical sizes and shapes. Means join the peripheries only of the plies to hold the same in substantial abutment with each other and a closed line of weakening is located in the one ply only and defines the periphery of a return postcard. The line of weakening is located to be spaced from and within the joining means. A franking designation or stamp receiving area is located on the one ply on the one side thereof facing the other ply and within the closed line of n weakening to be on the return postcard.

In a highly preferred embodiment of the invention, the foregoing structure additionally includes indicia on the side of the one ply opposite the one side with the franking designation and designating data requests to be completed by a receiver of the form. Return address indicia may be located on the one ply one side in proximity to the franking designation or stamp receiving area.

In a highly preferred embodiment, the business form is a postcard mailing piece and both of the plies are made of card stock like that employed in postcards. A further franking designation or stamp receiving area is carried on the side of the one ply remote from the other of the plies at a location outside the closed line of weakening.

The invention contemplates that the joining means include an adhesive and/or a fold.

The line of weakening preferably includes frangible means and in a highly preferred embodiment, the frangible means is a U-shaped perforation line and a slit extending between the legs of the U-shaped perforation line remote from and generally parallel to the bight of the U-shaped perforation line.

In a highly preferred embodiment, a recipient address receiving area is disposed on the side of the one ply remote from the other ply and within the line of weakening.

Other objects and advantages will become apparent from the following specification taken in connection with the accompanying drawings.

DESCRIPTION OF THE PREFERRED EMBODIMENTS

Figure 3:
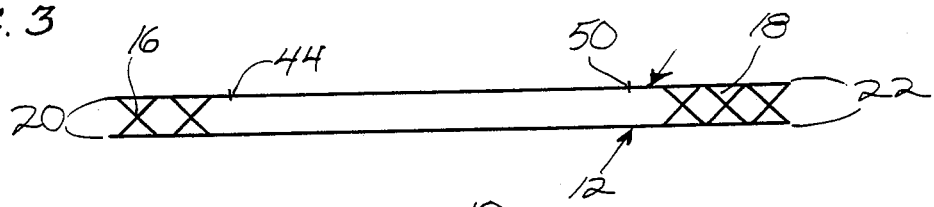
FIG. 3 is a somewhat schematic sectional view taken approximately along the line 3—3 of FIG. 1.
Figure 4:
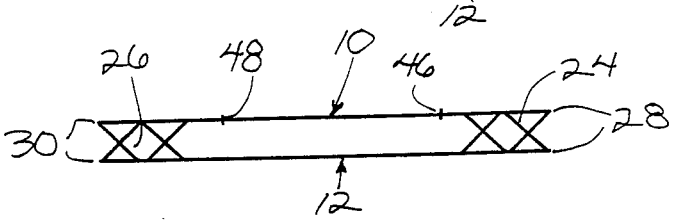
FIG. 4 is a somewhat schematic sectional view taken approximately along the line 4—4 in FIG. 1.
Figure 5:
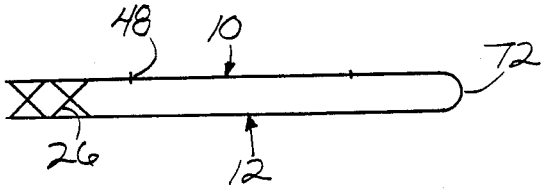
FIG. 5 is a view similar to FIG. 4 but showing a modified embodiment of the invention.

An exemplary embodiment of the invention is illustrated in FIGS. 1–4 with a modified embodiment additionally illustrated in FIG. 5. In both cases, the invention is illustrated in the form of a two-way postcard but it should be appreciated that the invention may be utilized as a business form provided with a return postcard. That is to say, the completed business form, before separation of the return postcard from the original structure, is not restricted to use as a mailing piece.

Figure 1:
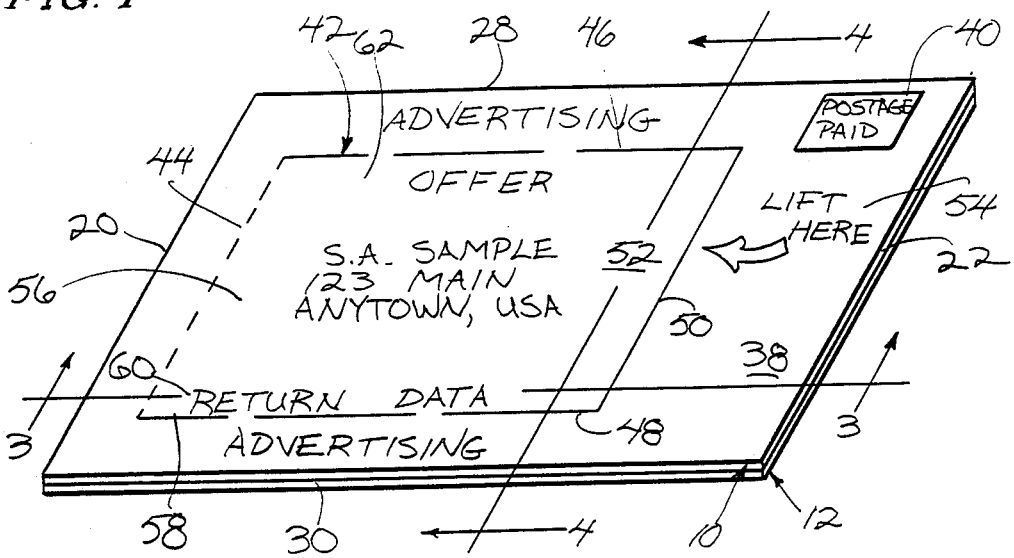
FIG. 1 is a plan view of a single form length of a business form made according to the invention.

Referring to FIG. 1, the business form is seen to be made up of two superimposed plies, namely, a top ply 10 and a bottom ply 12. The ply 10 will typically be made up of card stock like that employed in postcards. Preferably, but not necessarily, the ply 12 will be made up of similar stock.

The plies 10 and 12 are of identical size and shape and preferably are rectangular. About their peripheries only, they are joined to one another by adhesive. As seen in FIG. 3, spaced right and left side glue lines 16 and 18 respectively join the left and right peripheral edges 20 and 22 of the plies 10 and 12 As seen in FIG. 4, upper and lower peripheral glue lines 24 and 26 similarly join top and bottom edges 28 and 30 of the plies 10 and 12.

Returning to FIG. 1, the ply 10 includes an upper or exterior surface 38 and near the upper right hand corner, is provided with a first franking designation or postage stamp receiving area 40.

The ply 10 also includes a closed line of weakening, generally designated 42. This line of weakening 42 is formed in the upper ply 10 only and is located so as to be spaced from and within the glue line 16, 18, 24 and 26. In a preferred embodiment of the invention, the line of weakening 42 includes a U-shaped line of perforation having a bight 44 and top and bottom legs 46 and 48. A continuous slit 50 is generally parallel to the bight 44 and extends between the legs 46 and 48 at a location remote from the bight 44.

Because a part of the line of weakening 42 is in the form of the slit 50, a recipient of the business form may easily insert a finger or two into the interior of the form through the slit 50 and lift on the interior, rectangular section 52 defined by the line of weakening 42 to sever such section along the line of weakening 42. If desired, indicia 54 may be located on the surface 38 to instruct that such be done.

The section 52 includes an area 56 for receipt of address information identifying the person to whom the mailing piece is to be delivered when utilized as a two-way mailer. Once the area 56 is filled in with addressee information, it also serves as an area to identify a respondent to the mailing.

The section 52 may also include an area 58 which may be completed by the recipient with data that is sought in connection with the mailing. Indicia soliciting the data to be returned and designated by the legend 60 will be included in the area 58.

Where possible, the section 52 may also include an area 62 for receipt of an offer or solicitation indicia It should be kept in mind that the areas 56, 58 and 62 all are located on the exterior side of the top ply 10, that is, on the surface 38.

Figure 2:
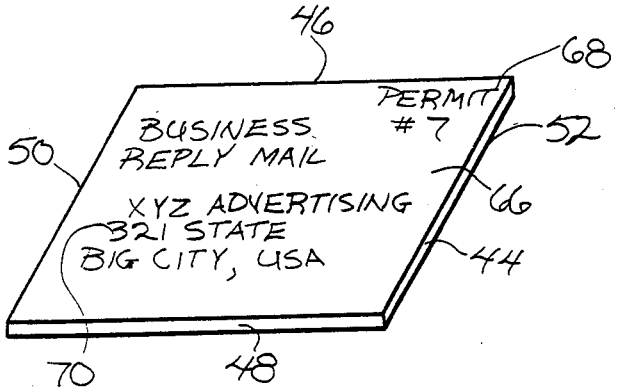
FIG. 2 is a plan view of a removable, return postcard part of the form illustrated in FIG. 1 after it has been removed from the form of FIG. 1.

FIG. 2 illustrates the section 52 after it has been removed from the assemblage illustrated in FIG. 1 and flipped 180°. Thus, the areas 56, 58 and 62 are not visible in FIG. 2, being on the undersurface of the section 52 as illustrated therein. The side 66 of the section 52 remote from that containing the areas 56, 58 and 62 is provided with a second franking designation or postage stamp receiving area 68 and an adjacent return address indicia receiving area 70. It will of course be appreciated that since the areas 68 and 70 are on the section 52, they are necessarily within the line of weakening 42.

The embodiment illustrated in FIG. 5 is identical to that just described save for the fact that one of the lines of adhesive 16, 18, 24, 26 is replaced by a fold. As illustrated in FIG. 5, the line of adhesive 24 has been replaced by a fold 72.

Though not shown herein, the business form of the invention may be assembled on conventional collating equipment and provided with one or more control punch margins that run longitudinally of a continuous business forms assembly made up of a plurality of individual form lengths such as shown in FIG. 1. In such a form, recipient address information may be printed by impact or laser or any suitable means under the direction of a computer in the areas 56. The control punch margins may be trimmed and the individual form lengths severed from the continuous form by any suitable means and then placed in the mail.

The recipient will receive the form in the condition illustrated in FIG. 1. By heeding the directions 54, the return postcard section 52 may be severed from the original mailing piece. Data sought by the mailing may be completed by response to indicia 60 in the area 58 either before or after offer information contained in the area 62 is read.

The return postcard 52 may then, without more, be deposited in the return mail because it will already have been prefranked or stamped in the area 68 and provided with the return address information in the area 70. In short, the recipient need only sever the return postcard 52 from the original mailer and provide the requested return data.

The mailing organization, upon receiving the return card 52 will be provided with the return data as well as an identification of the respondent since that information will remain in the area 56 from the original mailing. At the same time, the unique construction of the assemblage assures that the return mailing frank 68 and return address 70 are hidden during the original mailing so as not to cause confusion with postal authorities. Similarly, because the first frank or stamp receiving area 40 is severed from the section 52, information in the area 56 will not be utilized by postal authorities in the return mail process.

In some instances, the business form may not be used as a two-way mailer, but rather, may be included in a packet or kit of material as a means of providing an advertisement or offer with a self-contained response postcard In other instances, other types of personalization possibilities exist. For example, the section 52, in addition to carrying the recipient's address, might carry as in the area 62, a personalized question as, for example, "At what age will S.A. Sample earn an additional $1000?". Previously printed on the interior surface of the ply 12 below the section 52 may be a personalized answer such as "Age 42 if they invest $5000 by Oct. 1, 1988". It will, of course, be recognized that such a personalized answer appearing on the interior of the ply 12 could also be placed thereon after assembly of the form by utilizing suitable image transfer material at the interface of the plies 10 and 12.

Figure 6:
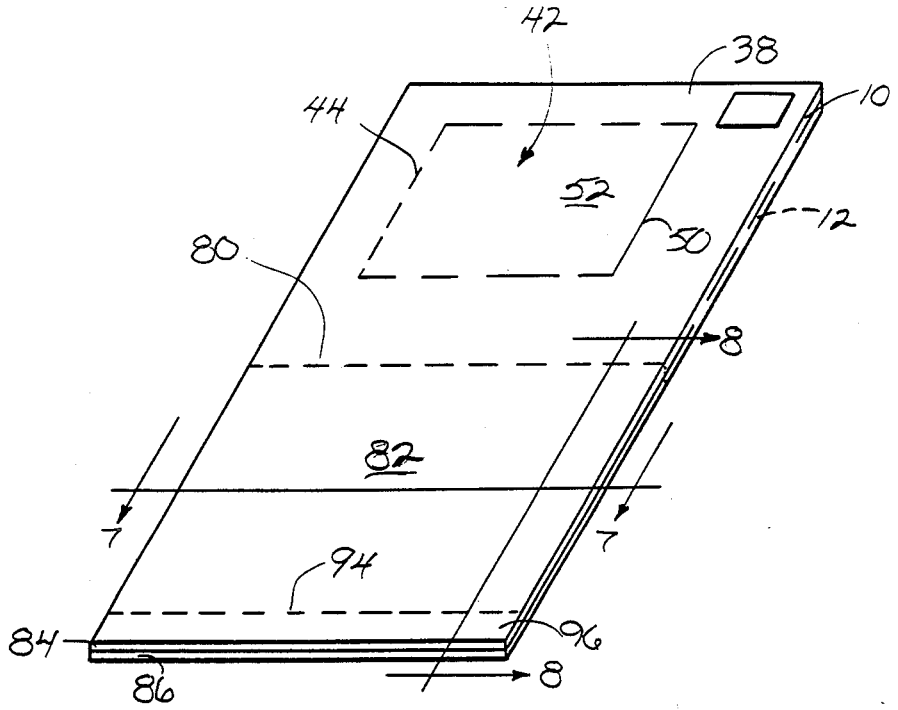
FIG. 6 is a plan view of a single form length of a modified embodiment of a business form made according to the invention.
Figure 7:
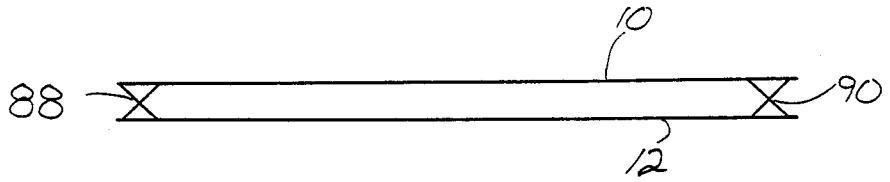
FIG. 7 is a somewhat schematic sectional view taken approximately along the line 7—7 in FIG. 6.
Figure 8:
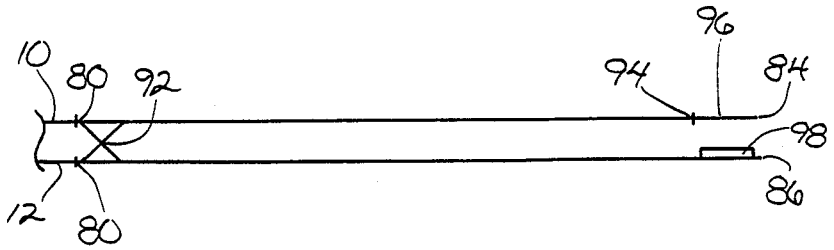
FIG. 8 is a somewhat schematic sectional view taken approximately along the line 8—8 in FIG. 6.

FIGS. 6–8 illustrate still another embodiment of the invention. In this embodiment, in lieu of the bottom edge 28, the plies 10 and 12 include a line of perforation 80 and a return envelope 82 removably joined to the business form by the line of perforation 80. That is to say, the plies 10 and 12 extend past the line of perforation 80 to terminate in edges 84 and 86 spaced therefrom as seen in FIGS. 6 and 8. A U-shaped glue line is disposed between the plies 10 and 12 to form the return envelope 82, the legs of which are shown at 88 and 90 in FIG. 7 while the bight is illustrated at 92 in FIG. 8. It will be seen that the legs 88 and 90 are closely adjacent respective side edges of the plies 10 and 12 while the bight 92 is closely adjacent to the line of perforation 80.

The upper ply 10 also includes a line of weakening 94, preferably in the form of a perforation, closely adjacent the edge 84 to define a removable chip 96. That portion of the ply 12 below the chip 96 may be provided with re-moistenable adhesive or pressure sensitive adhesive 98 as indicated in FIG. 8 on the side thereof facing the ply 10 thereby define a flap for the return envelope 82. That is to say, after removal of the chip 96, the underlying part of the ply 12 may be folded about the edge defined by the perf line 94 to overly the upper surface of the ply 10 and adhere to the same by means of the adhesive 98.

This form of the invention is ideally suited for use rectangular section 52 than is given by a postcard is desired. In such a case, the section 52 may be removed as mentioned previously and with the desired information inscribed thereon, and inserted into the return envelope 82. In this regard, the return envelope 82, on the exterior surface of the ply 12, may be preprinted with return address and/or franking indicia; and when so preprinted, the same surface of the business form on the opposite side of the line of perforation 80 may include an instruction to postal authorities to deliver to the address on the other side, that is, the address appearing in the area 56.

From the foregoing, it will be appreciated that a business form made according to the invention eliminates the effort required of a recipient to respond to a soliciting mailing. The same is simple and economically constructed and easy to use.

I claim:

1. A business form including a postcard mailing piece comprising:

first and second superimposed plies, each of card stock like that employed in postcards and having generally identical sizes and shapes;

means joining the peripheries only of said plies to hold the same in substantial abutment with each other;

a first franking designation or stamp receiving area on the side of one of said plies remote from the other of said plies;

a closed line of weakening in said one ply defining the periphery of a return postcard and located to be spaced from and within said joining means and not encompassing said first franking designation or stamp receiving area; and a second franking designation or stamp receiving area on said one ply on the side thereof facing said other ply within said closed line of weakening to be on said return post card.

2. The postcard mailing piece of claim 1 wherein said joining means includes an adhesive.

3. The postcard mailing piece of claim 2 wherein said joining means includes a fold.

4. The postcard mailing piece of claim 1 wherein said line of weakening includes frangible means.

5. The postcard mailing piece of claim 4 wherein said frangible means comprises a U-shaped perforation line and a slit extending between the legs of said U-shaped perforation line remote from and generally parallel to the bight of said U-shaped perforation line.

6. A two-way postcard mailing piece comprising:

first and second superimposed plies, each of card stock like that employed in postcards and having generally identical sizes and shapes;

means joining the peripheries only of said plies to hold the same in substantial abutment with each other;

a first address receiving area on the side of one of said plies remote from the other of said plies;

a first franking designation or stamp receiving area adjacent said first address receiving area;

a closed line of weakening in said one ply defining the periphery of a return postcard and located to be spaced from and within said joining means and not encompassing said first franking designation or stamp receiving area but encompassing said first address receiving area;

a second franking designation or stamp receiving area on said one ply on the side thereof facing said other ply within said closed line of weakening to be on said return postcard; and a second address receiving area for receiving a return address on said one ply on the side thereof facing said other ply and within said closed line of weakening and in adjacency to said second franking designation or stamp receiving area.

7. The postcard mailing piece of claim 6 wherein said line of weakening comprises a U-shaped perforation line and a slit extending between the legs of said U-shaped perforation line remote from and generally parallel to the bight of said U-shaped perforation line.

8. The postcard mailing piece of claim 6 wherein said remote side of said one ply, within said line of weakening contains an area bearing indicia for data requests to be completed by the recipient of the mailing piece.

9. A business form comprising:

first and second superimposed plies, at least one being of card stock like that employed in postcards and having generally identical sizes and shapes;

means joining the peripheries only of said plies to hold the same in substantial abutment with each other;

a closed line of weakening of said one ply only and defining the periphery of a return postcard and located to be spaced from and within said joining means; and a franking designation or stamp receiving area on said one ply on the one side thereof facing said other ply within said closed line of weakening to be on said return postcard;

indicia on the side of said one ply opposite said one side designating data requests to be completed by a receiver of said form; and return address indicia on said one ply one side in proximity to said franking designation or stamp receiving area.

10. The business form of claim 9 further including extensions of said plies and aligned lines of weakening in said plies defining a part of the periphery thereof; said extensions being joined together to define a return envelope removably secured to said business form along said aligned lines of weakening.

* * * * *